United States Patent [19]

Stuff, Jr.

[11] 4,423,874

[45] Jan. 3, 1984

[54] GOLF CLUB HEAD

[76] Inventor: Alfred O. Stuff, Jr., 1176-C Paseo Del Mar, Casselberry, Fla. 32707

[21] Appl. No.: 393,643

[22] Filed: Jun. 30, 1982

Related U.S. Application Data

[62] Division of Ser. No. 231,981, Feb. 6, 1981, Pat. No. 4,340,229.

[51] Int. Cl.[3] ..... A63B 53/08

[52] U.S. Cl. ..... 273/171

[58] Field of Search ..... D21/214–220; 273/171, 167 A, 167 B, 167 E, 167 D, 167 F, 169, 172

[56] References Cited

U.S. PATENT DOCUMENTS

| | | | |
|---|---|---|---|
| 1,431,313 | 10/1922 | Lawton | 273/172 |
| 1,505,296 | 8/1924 | Smith | D21/219 X |
| 1,555,425 | 9/1925 | McKenzie | 273/169 |
| 2,360,364 | 10/1944 | Reach | 273/171 |
| 2,445,718 | 7/1948 | Sternberg et al. | 273/167 B |
| 3,068,011 | 12/1962 | Sano | 273/169 X |
| 4,340,229 | 7/1982 | Stuff | 273/183 E X |

*Primary Examiner*—George J. Marlo
*Attorney, Agent, or Firm*—William M. Hobby, III

[57] ABSTRACT

A golf club head for a putter or the like having a sighting device by which the golfer may easily align the club head to maintain its horizontal plane parallel with the putting surface. The sighting device is a cylindrical cavity in the club head immediately behind the point on the club face at which the ball is struck. A light colored spot is concentrically disposed on the lower closed end of the cavity. A transparent disc is disposed over the upper open end of the cavity and has a concentric dark spot concentric therewith. The golfer establishes a vertical line of sight with respect to the ball and adjusts the plane of the club head to cause the lower spot to be in coincidence with the upper spot. The sole plate of the club head is relieved to the rear of the club face to minimize dragging and scuffing on the grass of the putting surface during a stroke. Recesses in the relieved areas are adapted to receive selectable size weights which permit the weight of the club head to be adjusted to suit the individual and to also balance the head or to vary the heel-to-toe weight ratio.

4 Claims, 17 Drawing Figures

GOLF CLUB HEAD

This application is a division, of application Ser. No. 231,981, filed 2/6/81 now U.S. Pat. No. 4,340,299.

BACKGROUND OF THE INVENTION

1. Field of the Invention.

The present invention relates to an improvement in golf clubs and more particularly to an improvement in a putter head.

2. Description of the Prior Art.

There are several important factors that a golfer must consider in making a putt. First, he must take care to strike the ball with the club face at the center of percussion for the head; otherwise, force vectors may be imparted at a direction other then the desired line of roll of the ball. Similarly, he must maintain the horizontal plane of the club parallel with the surface of the green to prevent departures from the line of roll. The golfer must also be able to accurately align the club face at right angles to the direction in which he wishes the ball to go. While these requirements are basically under the control of the golfer, there are requirements in the design of the club which also may influence the path of the ball and over which the golfer has little or no control. For example, the club and club head must be properly balanced so that the dynamic forces during a swing do not cause a change in the alignment of the club face with respect to the ball and the line of roll. Also, the drag of the grass during the stroke on the sole plate of the club can, on occasions, introduce changes in the alignment of the club just prior to striking the ball.

There have been a number of designs of putter heads which have attempted to solve some of these problems, but none are known which assist the golfer in overcoming all of the above mentioned problems. U.S. Pat. No. 2,478,468 to Drake has approached the balance problem by offsetting the head with respect to the shaft and has attemped to improve the scuffing problem by the curvature of the sole plate portion. Handzlik, Jr. in U.S. Pat. No. 2,991,082 has provided a putter head construction having a raised portion adjacent the so-called "sweet spot" of the face of the club to indicate to the golfer the proper point for striking the ball. Another alignment effort was made by Hodge in U.S. Pat. No. 3,486,755 in which the putter was to be used in the manner of a shuffleboard club. However, none of the referenced patents, or of clubs known in the prior art, have provided any assistance to the golfer to maintain the horizontal plane of the club parallel with the surface of the green. Thus, he must depend entirely on judgment and experience with respect to this requirement for accurate putting.

SUMMARY OF THE INVENTION

In the present invention, I have provided a novel golf putter head which can be accurately balanced and tailored to the individual golfer. The head is designed to greatly minimize the drag or scuffing of the sole plate of the club during a stroke. My club head also has a built in alignment device which will permit the golfer to very easily hold his putter with the horizontal plane of the club exactly parallel to the green. This same device also indicates the exact point on the club face at which the ball should be struck. Therefore, my device not only is advantageous in improving a golfer's putting because of its balance and minimum drag but also, by its novel alignment device, will assist golfers to develop the proper habits and muscle control.

As will be shown, the head of my novel putter can be fabricated economically from one of the heavier metals such as zinc, obviating the need to use the more expensive aluminum which has been found necessary to many prior art putters to minimize the weight of the club head. Advantageously, I provide a club head having a sole plate which is relieved except to the rear of the club face which forms a pair of ribs disposed at right angles to the face. The ribs curve upwardly to the rear edge of the club. This relief serves two purposes; it lightens the head, and reduces the drag on the putting surface. The relieved portions are provided with recessed holes in which various types of weights may be mounted to exactly balance the club and which are easily changeable to suit the individual golfer. On the top surface of the putter head, I provide a sighting device by which the golfer may determine when the horizontal plane of the head is exactly parallel to the green. The sighting device comprises a cylindrical recess or cavity extending downward into the club head and located just to the rear of the center of percussion of the club face. At the bottom of the cylindrical chamber, a small white or silver dot is disposed concentric with the cylinder with the remainder of the bottom a dark color, preferably black. At the top of the cylindrical cavity, a transparent disc is countersunk flush with the top surface of the club. At the center of the transparent disc a dark or black circular spot is disposed having approximately the same diameter as the light colored spot at the bottom of the chamber.

In aligning his club with the ball preparatory to putting, the golfer looks down vertically at the ball and places the club with the face just adjacent the ball at the point directly in front of the sighting device. The golfer then looks at the upper black spot and adjusts the angle of his club such that the bright spot at the bottom of the chamber is exactly covered by the upper black spot. As may be recognized, if the club head is being held in a non-parallel position a portion of the white or silvered spot will then be visible since the upper black spot will not be totally covering the lower bright spot. Once the golfer has the club properly aligned wherein the lower silvered spot is exactly covered by the upper black spot and the club face is centered with respect to the ball with respect to the direction of roll desired, the golfer may make his stroke with the perfectly balanced head swinging in a smooth arc with no forces tending to cause any slight rotation of the club during the stroke. The narrowed design of the sole will minimize any possible drag of the grass on the club. Therefore, the results of the putt will depend almost entirely on the skill of the golfer and will not be influenced significantly by departure of the club from the intended line of swing.

It is therefore a principal object of my invention to provide a golf putter which will permit a golfer to hold the horizontal plane of the head exactly parallel to the green.

It is another object of my invention to provide a putter head in which the golfer can accurately align the ball with the putter face at its center of percussion.

It is yet another object of my invention to provide a golf putter head which can be accurately balanced and adjusted for an individual golfer.

It is still another object of my invention to provide a golf putter in which there is a minimum drag or scuffing from the grass during a stroke.

It is a further object of my invention to provide a golf putter head which can be fabricated from zinc without introducing excessive weight to the head.

These and other objects and advantages of my invention will become apparent from the following detailed description and the drawings.

and

Figure 1:
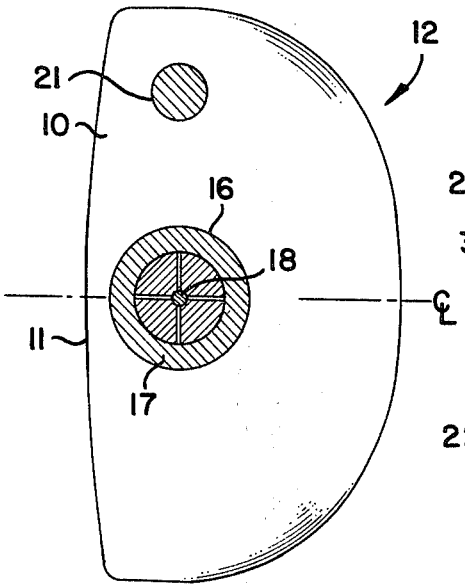
FIG. 1 is a top view of the putter head of my invention showing the appearance of one version of the sighting device.
Figure 2:
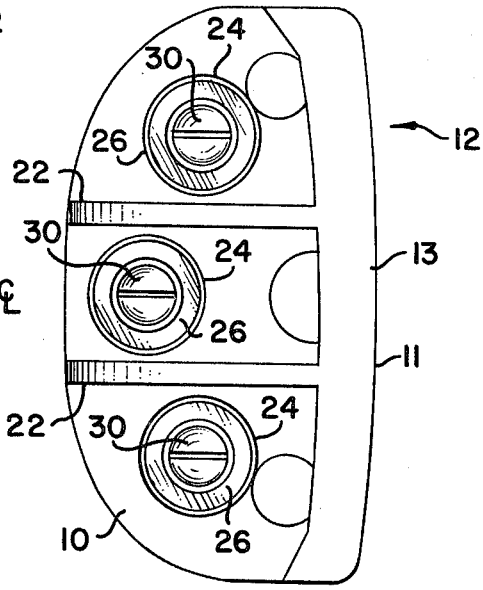
FIG. 2 is a bottom view showing the sole portion of my golf putter head indicating the position of the balance weights.
Figure 16:
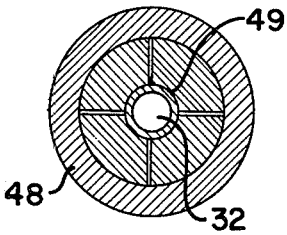
Figure 17:
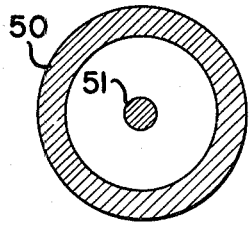

FIGS. 16 and 17 show two alternative upper spot designs for the sighting device of FIG. 1.

DETAILED DESCRIPTION OF THE PREFERRED EMBODIMENT

The construction of my improved golf putter head may be noted from FIGS. 1 through 4. Although the main body portion 12 may be cast from any desired metal, I prefer to utilize zinc for economy. The top surface of the club head seen in FIG. 1 shows the location of the attachment of the shaft 21 and, as illustrated, is for a left handed golfer. As will be seen, the casting 12 has an approximate "D" shape and is symmetrical; thus, the opening in the head for shaft 21 would be at the opposite end for a right hand club. At the center of the top surface 10 and adjacent to the center of the club face 11 may be noted sighting device 16 having a black outer ring 17, and a black inner spot 18 connected by cross hairs to black ring 17. The spot 18 as aligned with the fore and aft center line of the club which intersects the area on the club face 11 with which the ball should be struck. The sole plate of head 12 is shown in the bottom view of FIG. 2. A narrow transverse portion 13 of the casting may be noted extending rearward from the club face 11 and may also be seen in cross section in FIG. 3. Two ribs 22 extend from the club face portion 13 to the rear of the club head 12 having an upward curvature toward the rear as best seen from FIG. 3. This construction minimizes the drag or scuffing of the sole plate on the grass which is characteristic of prior art clubs having solid sole plates.

Provisions are made for attachment of three weights such as weights 26 to the underside of the club head in the relieved portions between ribs 22 and the face portion 13. The construction of the weights may best be seen in the cross sectional view of FIG. 3. While these weights may take on many shapes, I prefer to utilize a counterbored weight 26 and a washer 28 held in counterbored recess 24 by mounting screw 30. By forming weights from several different materials such as lead, aluminum, steel, plastic, and the like, a wide range of weight adjustment is available. This allows the putter head of my invention to be adjusted to satisfy the preferences of a wide range of golfers.

Of more importance however, is the use of the weights 26 and 28 to balance the club. With the shaft 21 in place, various size weights may be installed so as to produce both a fore and aft balance and a longitudinal balance. The most important balance is fore and aft with respect to the line of the club shaft and may be vary accurately obtained with my above described balancing means. However, many skilled golfers develop techniques which depend on a heel weight heavier than the toe weight or vice versa. Advantageously, the weight of the heel and toe portions of my putter head 12 may be independently adjusted by the individual user to satisfy such special requirements.

Figure 3:
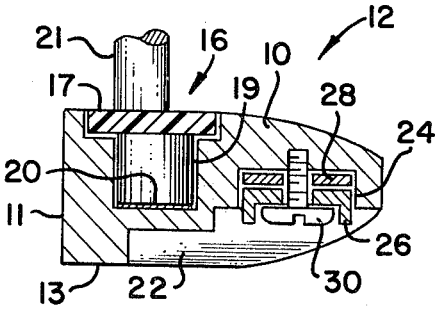
FIG. 3 is a cross sectional view of the golf putter head showing the sighting device cavity and details of the balance weights.

Turning now to sighting device 16, its construction will be apparent from FIG. 3. A cylindrical cavity 19 is provided in club head 12 and a thin disc 20 is disposed on the bottom surface of chamber 19. Preferably, disc 20 will have a flat black surface with a small white or silver spot in its center. The spot is formed to be about the same size as black spot 18 as seen in FIG. 1. At the top of cylindrical chamber 19, a transparent disc 17 is installed in a counterbore so as to be flush with the upper surface 10 of club head 12. For economy and durability. I prefer to utilize an acrylic plastic material or the like for disc 17. Disc 17 may hawe the pattern as shown in FIG. 1 attached to its top surface by means of a decal or the like.

Figure 4:
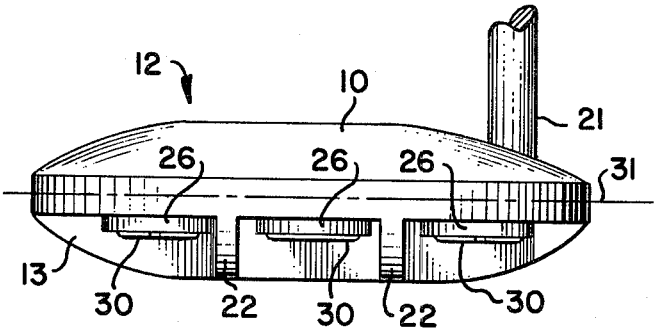
FIG. 4 is a rear view of the golf putter head showing the rib construction.

FIG. 4 shows a rear view of club head 12 with imaginary line 31 defining the horizontal plane of the putter head.

Figure 5:
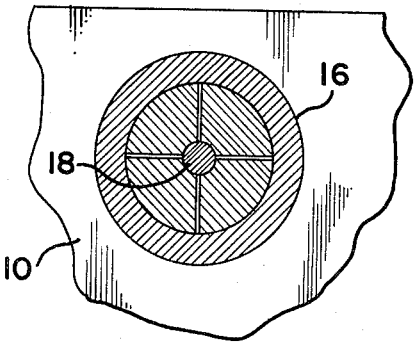
FIG. 5 shows a part of the top surface of the club head with the sighting device aligned with the horizontal plane of the club head parallel to the ground.
Figure 6:
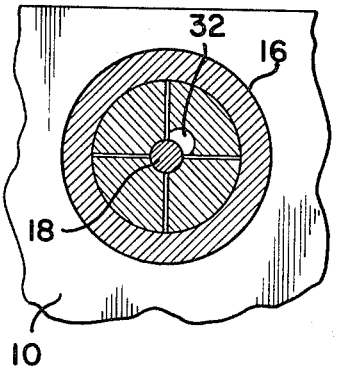
FIG. 6 shows the sighting device of FIG. 5 as it appears with the club not parallel to the ground.
Figure 8:
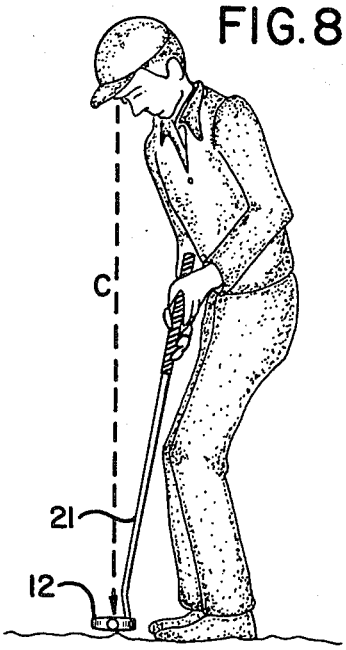
FIG. 8 shows a golfer using the sighting device to align the club.

The use of sighting device 16 will be described with reference to FIGS. 5 and 6. When a golfer lines up his putt, he will commonly use the stance such as shown in FIG. 8. He looks directly down at the ball represented by vertical dash line C. He then controls the angle at which he is holding the putter handle 21 so as to cause the lower silver spot on disc 20 to become coincident with upper black spot 18 which insures that the horizontal plane 13 of the club head 12 is exactly parallel with the surface of the putting green. This condition is easily and clearly apparent to the golfer since misalignment, as illustrated in FIG. 6, causes the lower silvered spot 32 to be clearly visible on its black background since the upper spot 18 is not covering it. In addition, the golfer may use the fore and aft cross hair to properly align the putter with the ball since this represents the proper area on club face 11 with which the ball should be struck.

Figure 7:
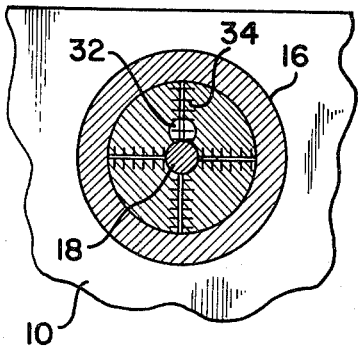
FIG. 7 shows a sighting device having calibration lines such that a deliberate pull, push, slice or hook may be generated.

Although I have described my sighting device 16 as applied to an improved putter head design, it will be obvious that the device may also be used with other clubs such as drivers. However, in installing the device in a driver, it is necessary to have the cylindrical cavity oriented so that the lower and upper spots are in coincidence when the golfer is holding the club at the correct orientation since he would not, in driving, be in a stance such as used for putting. When my sighting device is adapted for a driver or the like, the cross hairs may also include reticle marks 34 as seen in FIG. 7. An expert golfer using this application may find that he executes a straight drive position so that the lower spot 32 touches a selected reticle line, that he can thereby produce a slice or a hook as may be required for a particular shot. A less expert golfer who may have learned poor driving habits can also utilize the reticle by experimentally determining the proper off-center position of spot 32 to cure a natural hook or slice. Thus, my sighting device is a valuable aid for golfers of all skill levels. Of course, the reticle lines may also be used in the sight for putters to permit a golfer to deliberately pull or push the ball, or to compensate for previously acquired bad habits.

ALTERNATIVE EMBODIMENTS OF THE SIGHTING DEVICE

While I have shown a simple and effective sighting device design above, certain alternative designs may be preferred or useful and are considered to fall within the scope of my invention.

Figure 9:
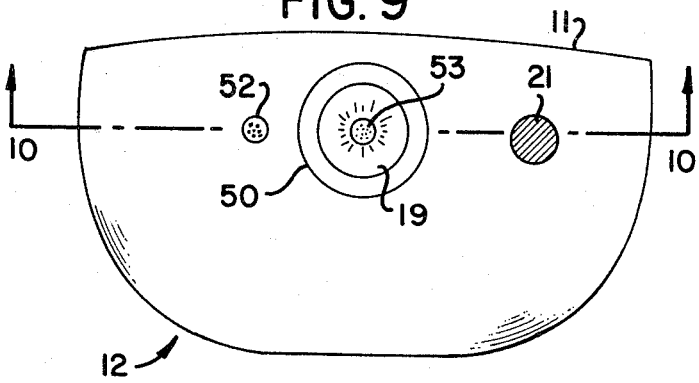
FIG. 9 shows an alternative sighting device utilizing fiber optics to produce a bright spot.
Figure 10:
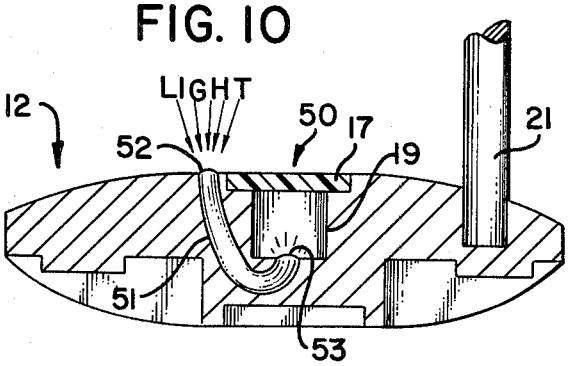
FIG. 10 is a cross section of the club head of FIG. 9.

FIGS. 9 and 10 disclose an alternative sight 50 which will produce a very bright and glowing lower spot. Best seen in FIG. 10, sight 50, comprises cylindrical cavity 19 with a round tubular channel 51 having one end opening into the closed end of cylindrical cavity 19 concentric therewith and the other end opening through top surface 10 of club head 12. A bundle of fiber optics 54 is disposed in channel 51. The top end 52 receives the ambient sunlight which emanates from end 53. Any of the previously described upper spot devices may be used although transparent disc 17 is indicated in FIG. 10. In FIG. 9, the upper disc is omitted to illustrate the bright spot formed by light from end 53.

Figure 11:
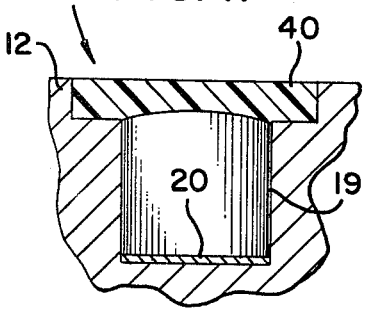
FIG. 11 shows an alternative sighting device having the upper disc in the form of a concave lens.
Figure 12:
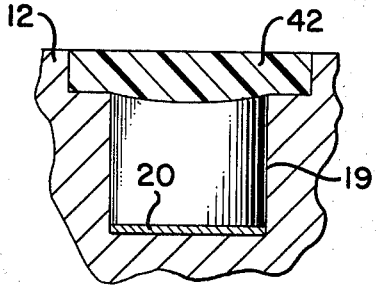
FIG. 12 shows another alternative sighting device in which the upper transparent disc is in the form of a convex lens.

Turning now to FIG. 11, a sighting device 16 is shown in which the upper transparent disc 40 has a convex shape to its underside. This construction has the advantage of causing the lower spot 32 on lower disc 20 to appear much farther away than the upper spot 18 due to the lens effect of disc 40 to produce a more sensitive indication which may be preferred by some golfers. The opposite effect of causing the lower spot 32 to appear at a closer distance may be achieved with the design shown in FIG. 12 in which upper disc 42 has a convex shape and may be preferred by others.

Figure 13:
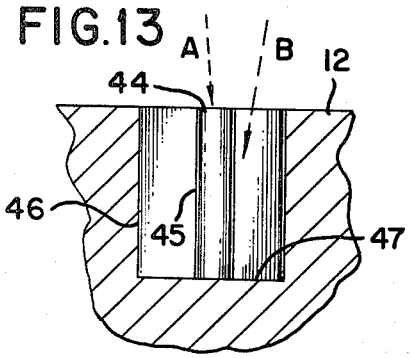
FIG. 13 shows another alternative sighting device in which a cylindrical post is utilized.
Figure 14:
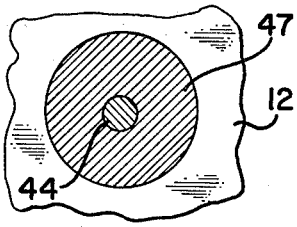
FIG. 14 shows the sighting device of FIG. 13 in the top of a club which is being properly held to maintain the club parallel with the green.
Figure 15:
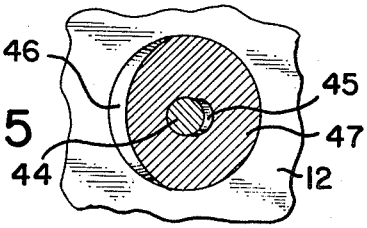
FIG. 15 shows the sighting device of FIG. 10 in which the club is not being held parallel with the putting surface.

Another embodiment is illustrated by FIG. 13 in which a cylindrical cavity 46 is provided in club head 12 and a small cylindrical post 45 is attached to the closed end concentric with cylinder cavity walls 46. The top surface 44 of post 45 is blackened and the sides of post 45 are brightly polished. The bottom surface 47 of cylindrical chamber 46 is blackened while the inner walls of chamber 46 may be white. As may be recognized, when the club is properly aligned, the line of sight shown by arrow A will cause black spot 44 as seen in FIG. 14 to meld with the area 47 which is also black to give a clear indication of a level club. If the club is not being held level then the line of sight such as indicated by arrow B will occur, producing the pattern shown in FIG. 15 in which the bright portion of post 45 is seen as well as a portion of wall 46.

FIGS. 16 and 17 show alternative patterns for the sight 16 of the preferred embodiment. In FIG. 16, a black ring 49 is provided having cross hairs and black outer ring 48. In this case, centering of silvered spot 32 in inner ring 49 indicates correct alignment. The design of FIG. 17 is identical to that shown in the preferred embodiment but with the omission of the recticle lines which may be desired by some users.

While I have shown a number of specific designs in the preferred embodiment and the alternative embodiments of my invention, it will be obvious to those of skill in the art that many variations and modifications may be made which will perform the same functions in the same manner. Such obvious changes are considered to fall within the spirit and scope of my invention.

I claim:

1. A putter head for a golf club comprising:

an elongate front face having a centrally located ball-contacting area;

an essentially continuous top surface having an approximate "D" shape wherein said front face represents the relatively straight portion of said "D" shape;

a sole plate extending rearwardly from said front face, a portion of said sole plate being curved upwardly from a point intermediate between said front face and the rear edge of said putter head;

at least three relieved areas in said sole portion disposed rearwardly from said front face and extending to said rear edge, said relieved areas defining at least two ribs forming said rearwardly extending portion of said sole plate thereby minimizing the area of said sole plate which will be in contact with the putting surface during a putting stroke.

2. The putter head as defined in claim 1 in which said relieved areas include means for changeably attaching balancing weights whereby the weight of said putter head may be tailored to the requirements of an individual golfer.

3. The putter head as defined in claim 1 in which said relieved areas include mounting means for attaching adjustable weights thereto, whereby said putter head can be accurately balanced to prevent dynamic forces from affecting the accuracy of a swing of the club.

4. The putter head as defined in claim 2 or 3 in which:

said mounting means comprises circular recesses having concentric tapped holes therein; and a set of washer-like weights selected from a group of said weights in which the values of the weight of said group are distributed over a wide range.

* * * * *